US010737873B2

(12) United States Patent
Lebon et al.

(10) Patent No.: US 10,737,873 B2
(45) Date of Patent: Aug. 11, 2020

(54) FLOW-LIMITING DEVICE AND CONTAINER FOR UNITARY PRODUCTS

(71) Applicant: CLARIANT HEALTHCARE PACKAGING (FRANCE) SAS, Choisy le Roi (FR)

(72) Inventors: Jacquy Lebon, Challands (FR); Dominique Bois, Montreuil aux Lions (FR)

(73) Assignee: Clariant Healthcare Packaging (France) SAS, Choisy le Roi (FR)

( * ) Notice: Subject to any disclaimer, the term of this patent is extended or adjusted under 35 U.S.C. 154(b) by 0 days.

(21) Appl. No.: 15/740,512

(22) PCT Filed: Aug. 9, 2017

(86) PCT No.: PCT/EP2017/070178
§ 371 (c)(1),
(2) Date: Dec. 28, 2017

(87) PCT Pub. No.: WO2018/050369
PCT Pub. Date: Mar. 22, 2018

(65) Prior Publication Data

US 2019/0218017 A1 Jul. 18, 2019

(30) Foreign Application Priority Data

Sep. 19, 2016 (EP) ..... 16306188

(51) Int. Cl.
*B65D 83/04* (2006.01)
*B65D 47/06* (2006.01)
(Continued)

(52) U.S. Cl.
CPC ..... *B65D 83/0427* (2013.01); *B65D 47/06* (2013.01); *B65D 51/244* (2013.01);
(Continued)

(58) Field of Classification Search
CPC ..... B65D 83/049; B65D 51/22; B65D 51/24; B65D 83/0481; A61J 1/03; A61J 7/0076
(Continued)

(56) References Cited

U.S. PATENT DOCUMENTS 3,730,387 A * 5/1973 McConnell ..... B65D 83/0409 221/265
3,866,805 A * 2/1975 Hamilton, Jr. ..... G01F 11/46 222/427
(Continued)

FOREIGN PATENT DOCUMENTS

CN 201195625 Y 2/2009
DE 102004049349 A1 4/2006
(Continued)

OTHER PUBLICATIONS

International Search Report with Written Opinion dated Oct. 17, 2017 with respect to international application No. PCT/EP2017/070178.

*Primary Examiner* — Rakesh Kumar
(74) *Attorney, Agent, or Firm* — Scott R. Cox

(57) ABSTRACT

A flow-limiting device that controls the distribution of unitary products from a container for holding said unitary products includes at least one dispensing opening, a body made of a polymeric material with an entry side, a dispensing side and a peripheral side extending in an axial direction of the body. The peripheral side has a lower and an upper axial end, the entry side has at least in part, a concave shape when viewed onto the entry side with at least one guiding surface. The dispensing side has at least in part, a concave shape when viewed onto the dispensing side. The dispensing opening is at an axial position between and spaced from the axial positions of the lower and upper axial end, wherein the entry side and/or the dispensing side include a plurality of
(Continued)

elevated regions, which are arranged to define the concave shape.

20 Claims, 6 Drawing Sheets

(51) Int. Cl.
*B65D 51/24* (2006.01)
*B65D 51/18* (2006.01)

(52) U.S. Cl.
CPC ..... *B65D 83/0481* (2013.01); *B65D 51/185* (2013.01); *B65D 2583/0436* (2013.01)

(58) Field of Classification Search
USPC ..... 221/233, 95, 252, 4, 288; 206/539, 457, 206/534; 222/142.9, 153, 487; 220/253, 220/258, 266, 153
See application file for complete search history.

(56) References Cited

U.S. PATENT DOCUMENTS 4,288,006 A * 9/1981 Clover, Jr. ..... B65D 47/265 206/534
4,308,979 A * 1/1982 Otterson ..... B65D 47/265 220/253
4,377,236 A * 3/1983 Montgomery ..... B65D 50/06 206/534
4,454,962 A 6/1984 Greenspan
4,460,106 A * 7/1984 Moulding, Jr. .... B65D 83/0409 221/1
4,530,447 A * 7/1985 Greenspan ..... B65D 83/04 221/288
4,541,541 A * 9/1985 Hickman ..... B65D 55/02 220/253
4,567,995 A * 2/1986 Kreiseder ..... B65D 47/265 220/253
4,611,725 A * 9/1986 Kacalieff ..... B65D 47/265 220/253
5,176,277 A * 1/1993 Schuermann ..... B65D 47/265 220/253
5,193,704 A * 3/1993 Kick ..... B65D 47/265 220/253
RE34,263 E * 5/1993 vanKerkhoven .... B65D 47/265 220/253
5,269,432 A * 12/1993 Beckertgis ..... B65D 47/265 215/250
5,383,582 A * 1/1995 Baxter ..... B65D 47/265 222/480
5,407,107 A * 4/1995 Smith ..... B65D 47/265 222/548
5,421,472 A * 6/1995 Beckertgis ..... B65D 47/265 220/253
5,542,579 A * 8/1996 Robbins, III ..... B65D 41/26 222/158
5,549,217 A * 8/1996 Benarrouch ..... B65D 83/0409 221/155
5,736,616 A 4/1998 Ching et al.
5,850,919 A * 12/1998 Freed ..... B65D 25/08 206/534
5,850,944 A * 12/1998 Robbins, III ..... B65D 47/0866 222/158
6,142,337 A * 11/2000 Schreckenberg ..... A61J 1/03 221/263
7,240,795 B2 * 7/2007 Lee ..... B65D 25/04 206/457
7,377,401 B2 * 5/2008 Humphrey ..... G07F 11/44 221/133
7,748,569 B2 * 7/2010 Sunatori ..... A47J 47/04 222/142.3
7,780,008 B2 8/2010 Portier
7,909,212 B2 * 3/2011 Parve ..... B65D 47/0847 222/480
7,967,160 B2 * 6/2011 Rault ..... B65D 51/20 215/255
8,757,382 B1 * 6/2014 Crawford ..... B65D 83/0481 206/534.2
9,669,989 B2 * 6/2017 Sanders ..... B65D 83/0409
2007/0269401 A1 11/2007 Portier
2009/0308868 A1 * 12/2009 Portier ..... B65D 83/0427 220/200
2014/0257185 A1 * 9/2014 Bechmann ..... A61M 5/2033 604/135
2017/0369228 A1 * 12/2017 Bartley ..... B65D 83/0481

FOREIGN PATENT DOCUMENTS

GB 2092108 A 8/1982
JP 2014/061898 A 4/2014
WO WO9948963 9/1999

* cited by examiner

FLOW-LIMITING DEVICE AND CONTAINER FOR UNITARY PRODUCTS

FIELD OF THE INVENTION

The invention relates to a flow-limiting device for controlling the distribution of unitary products to be fitted into a container for such unitary products, a container and its use.

PRIOR ART

Flow-limiting devices are devices for distributing and/or controlling the discharge of unitary products from a storage container.

Flow-limiting devices for containers are widely known. Typically when opening a container holding unitary products like pills, the pills can spill out of the container. This creates the need for flow-limiting devices which make it possible to administer only one product at a time.

Unitary products can be, for example, pharmaceutical, cosmetic, nutritional, veterinary or diagnostic products. In the case of pharmaceutical products, these can be tablets, dragees, pills, lozenges, pastilles, granules or capsules.

Flow-limiting devices often have a conical shape which serves to direct the loose products inside the container towards a dispensing opening. This helps to dispense the product but can generate a problem in that a product once dispensed cannot easily be returned into the container. This is necessary in case that a user dispensed a pharmaceutical product and realized that, according to the prescription, it has to be taken at some other time of the day. Further, this is necessary in case that a user inadvertently dispensed two products at one time and wants to return one product into the container.

US 2007/0269401 A1 discloses a flow-limiting device for loosely stored unitary products. The flow-limiting device can be fixed onto the neck of a container. When fixed onto the neck of the container, the entry side facing the interior of the container is provided with a cone shaped geometry which serves to direct the products one by one to a discharge opening. A suitable structure which helps to redirect dispensed products into the container is not provided.

In the related art, several different geometries of flow-limiting devices have been described. Some of the suggested geometries suffer from the drawback that they are relatively massive and heavy.

DESCRIPTION OF THE INVENTION

It is an object of the invention to provide a flow-limiting device to be fitted into a container for controlling the distribution of unitary products which is convenient to use and of a light construction.

This object is solved by flow-limiting device with the features of claim 1 and a container equipped with such flow-limiting device with the features of claim 12. The inventive use of such a container is described by the features of claim 16.

According to the invention, a flow-limiting device for controlling the distribution of unitary products to be fitted into a container for such unitary products comprises at least one dispensing opening, a body made of polymeric material with an entry side, a dispensing side and peripheral side extending in an axial direction of the body, the peripheral side having a lower axial end and an upper axial end. The entry side has, at least in part, a concave shape when viewed onto the entry side with at least one guiding surface for guiding a unitary product to be dispensed towards the at least one dispensing opening. The dispensing side has, at least in part, a concave shape when viewed onto the dispensing side. The at least one dispensing opening is at an axial position between and spaced from the axial positions of the lower axial end and the upper axial end. The entry side and/or the dispensing side comprise a plurality of elevated regions, preferably ribs, which are arranged to define the concave shape.

The term "polymeric material" covers materials comprising thermoset polymers and thermoplastic polymers. The flow-limiting device can be produced by injection molding or by compression.

The term "at least in part concave" describes an overall concave shape which, however, might also have one or more regions which do not have a slope but surface portions which are substantially orthogonal to the longitudinal axis of the flow-limiting device. Especially, the flow-limiting device might have a surface around a centrally arranged opening which might be planar.

In such a flow-limiting device, both the entry side and the dispensing side have at least in part a concave shape. When the flow-limiting device is fitted into a container, the entry side is that facing the interior of the container whereas the dispensing side faces the outside of the container. By means of the guiding surface on the entry side, a product to be dispensed can be guided towards the at least one dispensing opening. In case that a unitary product should be returned into the container, the dispensing side has also a concave shape which is formed so as to guide a product placed onto the concave part of the dispensing side towards the dispensing opening and back into the container. When during the turning upside down and the dispensing of a product, more than one product should be dispensed, the container with the inventive flow-limiting device simply has to be brought back in its regular, upstanding position with the dispensing side facing upwards and the second piece of product will be redirected towards the dispensing opening and into the container.

In order to avoid the flow-limiting device with a double concave shape to become too massive, either one of the two sides or both of them comprise a plurality of elevated regions and preferably ribs, the elevated surfaces of which define the overall concave shape of the entry side and/or the dispensing side. In other words, the elevated regions have an elevation in an axial direction of the flow-limiting device. The arrangement of the elevated regions and their geometries are selected such that the unitary products cannot enter the recessed spaces between the elevated regions. In such a way, the overall material which is required to form the flow-limiting device with a double-concave shape can be considerably reduced without compromising the functionality, namely to use the concave shapes to direct the unitary products to be dispensed towards the dispensing opening. Therefore, the geometry of the elevated regions and especially the spacing between them will have to be designed in view of the unitary products to be stored in a container for such flow-limiting device.

A further advantage associated with the specific geometry with a plurality of elevated regions and preferably ribs follows if, according to a preferred embodiment, the plastic material comprises a thermoplastic material and an active gas treatment material or gas treatment composition embedded in the polymer matrix of the thermoplastic material. In such a case, the effectiveness of the gas treatment is greatly enhanced because the complex geometry with a plurality of elevated regions and recessed regions in between considerably increases the exchange surface with the surrounding atmosphere. This advantage will be realized even in case that the elevated regions are only provided at the dispensing side of the flow-limiting device. In case that a specific treatment of the interior atmosphere of the container is required, the container will have to be closed and hermetically sealed by means of a cap unless it is opened for distribution of a unitary product. In such a case, the in-situ treatment of the gaseous atmosphere of the container will also become effective because of the exchange of air through the at least one dispensing opening.

Especially when using the flow-limiting device for a container for pharmaceutical products or diagnostic products, it can be essential to ensure the preservation of a suitable atmosphere in the container in order to avoid a chemical degradation of the products and to increase the shelf life of the containers.

According to a preferred embodiment of the invention, the gas treatment material comprises an oxygen scavenger.

As an alternative preferred embodiment or in combination with an oxygen scavenger, the gas treatment material can comprise a sorbent material and preferably a desiccant material or desiccant composition. A suitable treatment agent used by introduction into and mixture with the thermoplastic polymer can advantageously be selected from known reaction agents and/or gaseous pollution adsorbing agents such as dehydrating agents, oxygen scavengers, odor collectors, collectors of ammonia (NH3), alcohols, aldehydes, ketones, sulfurdioxide (SO2), hydrosulfuric acid (H2S), mercaptans, alkenes, in particular ethylene, alkynes, carbon dioxide (CO2), carbon monoxide (CO), nitrogendioxide (NO2), alkanes, in particular methane (CH4), halogens in particular fluorine, and/or desorption agents in the internal atmosphere of the containers such as volatile olfactory agents. A suitable desiccant material can be selected among silica gel, molecular sieve, clay or CaO.

Preferably, the at least one dispensing opening comprises a hole having a shape that is adapted to the shape of the unitary product to distribute such that only one unitary product at a time can pass through the dispensing opening. Preferably, the at least one dispensing opening comprises an elongate hole or elliptical hole. Such shapes are suitable for dispensing non-spherical and especially oblong products.

According to a preferred embodiment of the invention, the at least one dispensing opening comprises two elongate holes or elliptical holes, the longitudinal axes of which form an angle with each other, the angle preferably being between 80° and 100°. Such a shape was found to provide good results in tests when, during dispensing of oblong products, the container is turned in any angular orientation.

Preferably, the elevated regions comprise a plurality of radial ribs. For a circular flow-limiting device, the provision of radial ribs provides a high structural strength. The upper elevated surfaces of the radial ribs which define the concave shape direct the unitary products towards the dispensing opening when dispensing or when returning products back into the container. Preferably, the maximum interval between two adjacent ribs is less than the minimal size/dimension of the product to be dispensed. The provision of the ribs on the entry side of the flow-limiting device is preferred for aesthetic reasons.

Preferably, the elevated regions comprise at least one circumferential rib which is preferably arranged concentrically with respect to a longitudinal axis of the flow-limiting device. The provision of at least one circumferential rib is especially beneficial in combination with the provision of radial ribs. It is the nature of radial ribs that the spaces between adjacent ribs increase in a direction radially outwards. Therefore, in addition to the increased structural stiffness of a thin-walled flow-limiting device by means of at least one circumferential rib, the arrangement of circumferential ribs can also have the beneficial effect of preventing a unitary product to enter and become stuck in the spaces between adjacent radial ribs.

According to an especially preferred embodiment of the invention, the flow-limiting device comprises intersecting ribs, which provide for a maximum structural strength. This makes it possible to further decrease the material consumption for producing the flow-limiting device. Further, the provision of intersecting ribs further increases the surface area of the flow-limiting device towards the surrounding atmosphere.

Preferably, the flow-limiting device further comprises an annular flange at the circumference of the dispensing side of the flow-limiting device, the annular flange extending radially outwards from the upper axial end of the peripheral side. Such flange simplifies the correct positioning of the flow-limiting device inside the opening region of a container.

According to a preferred embodiment, the flow-limiting device further comprises axial ribs extending in a longitudinal direction of the flow-limiting device at the circumference thereof. In other words, the axial ribs run in the axial direction of the flow-limiting device and are provided on the peripheral side of the body. Such axial ribs increase the overall strength of the flow-limiting device. Further, the axial ribs have the function to reduce the friction when fitting the flow-limiting device into the corresponding container. Especially when using a force fit connection, the axial ribs will deform under the radial pressure acting between the mouth region of the container and the axial ribs.

According to a preferred embodiment, the flow-limiting device further comprises a bow bridging the opening on the entry side of the flow-limiting device. Such a bow can be integrally formed with the flow-limiting device and is a thin, blade-like element which is positioned at some distance to the opening. When turning upside-down the container for dispensing, the unitary products are prevented from falling directly into the dispensing opening so that the products will be guided one-by-one towards the dispensing opening.

Preferably, the flow limiting device further comprises a plurality of flow-breaking elements which are arranged on the entry side and extend around the dispensing opening and extend into the dispensing opening. The flow-breaking element also serve to reduce the flow of unitary products towards and through the dispensing opening which further promotes the desired dispensing of the unitary products one-by-one.

The inventive container for storing unitary products, especially pharmaceutical products, in its interior comprises an inventive flow-limiting device, a container body with a container opening and a removable or openable cap for closing the container opening. The flow-limiting device is arranged in the interior of the container and close to the container opening. The at least one dispensing opening of the flow-limiting device is dimensioned to allow the passage of one unitary product at a time. Thus, the inventive container and the geometry of the flow-limiting device are specifically adapted and dimensioned in view of a specific product to be stored in its interior.

According to a preferred embodiment of the invention, the flow-limiting device establishes a form-fit connection in the container and preferably snap-fit into the container. In general, various different securing means can be considered, such for example a force-fit, a clipping connection with a notch and groove on one or the other of the co-acting surfaces, a differential thermal shrinkage or a screw connection. However, it is preferred to provide any type of snap-fit or generally some kind of form-fit connection in the container, because a snap-fit connection gives a suitable audible feedback when mounting that the flow-limiting device has been appropriately fitted into the container.

Preferably, the container has a neck portion with an opening surrounded by a wall, and a flow-limiting device is provided with an annular flange at the upper axial end of the body of the flow-limiting device, wherein the flange is arranged such as to cover at least a part of the top surface of the wall around the neck portion. Such geometry is a simple way to axially position the flow-limiting device in a well-defined way relative to the container. It is introduced into the container until the flange comes to lie on the wall around the neck portion. Then, the correct position of the flow-limiting device has been reached. The upper portion of the wall of the container can also be provided with a shoulder created from a reduction of the wall thickness, where the flange of the flow-limiting device can rest on. A peelable foil can also be sealed by induction onto sealing surfaces created by the top surface of the wall of the container and/or the top surface of the flange of the flow limiting device, such as for example described in U.S. Pat. No. 7,780,008 which is incorporated herein by reference.

The container can have any suitable shape. It can have a straight cylindrical shape or the shape resembling a bottle with a neck portion comprising the container opening. Preferably, the container has a neck portion. The axial height of the flow-limiting device and the corresponding storage container can be designed such that the axial height of the flow-limiting device is equal to or lower than the height of the neck of the container. Such design avoids the occurrence of dead zones between the flow-limiting device and the surrounding region of the container, in which unitary products could become stuck.

According to the invention, the inventive container is used for storing and dispensing diagnostic products, tablets, dragees, pills, lozenges, pastilles, granules or capsules.

BRIEF DESCRIPTION OF THE DRAWINGS

In the following, some specific embodiments of the invention will be described with reference to the drawings in which.

DESCRIPTION OF PREFERRED EMBODIMENTS

Figure 1:
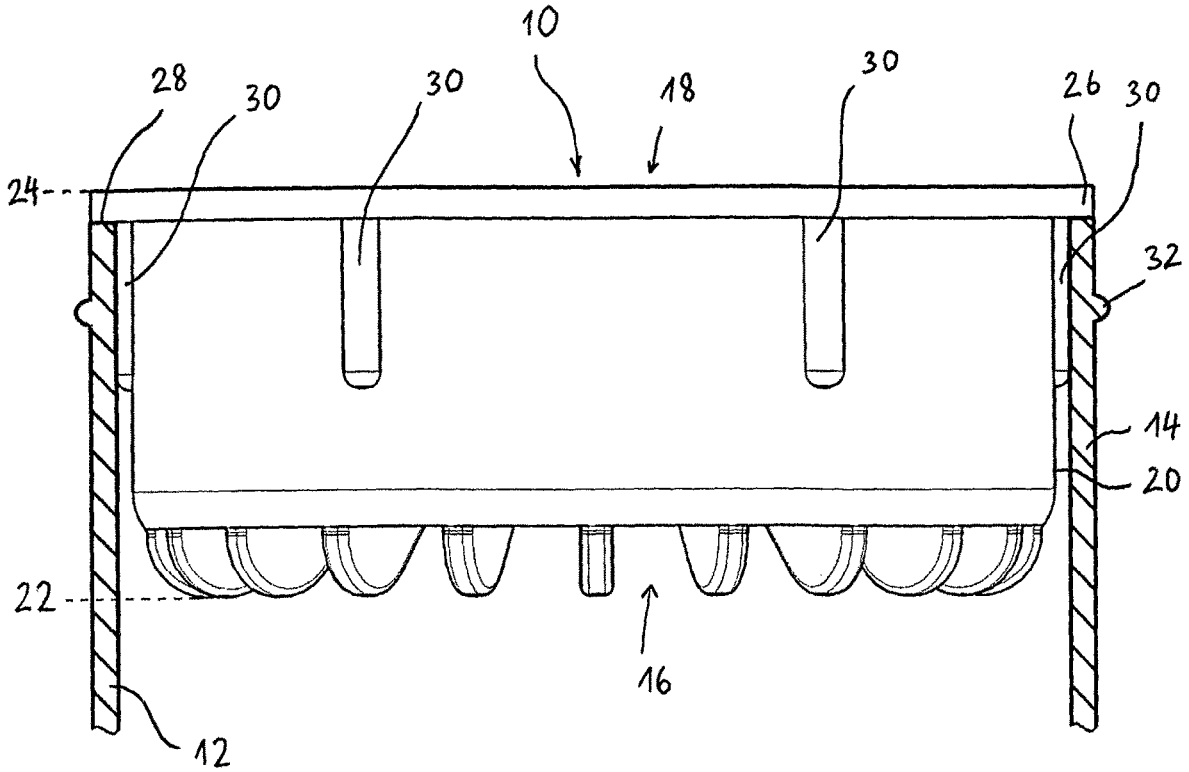
FIG. 1 shows an elevational view of an inventive flow-limiting device fitted into a wall around the opening region of a container.

Throughout the description below of preferred embodiments of the invention, the same elements will be indicated by the same reference numerals.

When reference is made to geometrical relationships like upper or lower, a container with the flow-limiting device according to the invention is considered to stand on a flat surface so that the opening of the container faces in an upward direction.

If a container of a different shape and with a dispensing opening which is angularly arranged with respect to a vertical direction should be used, the terminology can be adapted accordingly.

FIG. 1 schematically shows a flow-limiting device 10 which is fitted into a container 12. The container 12 is only partially shown. In the example as shown in FIG. 1, it has an annular wall 14 surrounding a container opening. The container 12 as such can either have a cylindrical shape with the wall 14 extending upwards from a bottom wall of the container. It is also possible to provide a container 12 with a neck portion resembling the common shape of a bottle. In such a case, the wall 14 forms part of the neck portion of the container.

The flow-limiting device 10 is fitted into the container 12 by means of a force-fit. The flow-limiting device 10 has an entry side 16 and a dispensing side 18. Further, the body of the flow-limiting device has a peripheral wall 20 in the shape of an annular ring. The peripheral wall 20 extends between the lower axial end 22 and the upper axial end 24. At the upper axial end 24, the flow-limiting device is integrally formed with an annular flange 26 which is shaped so that, once the flow-limiting device has been fitted into the container 12, it comes to rest on the annular upper surface 28 of the wall 14 and defines the mounting position of the flow-limiting device relative to the container 12.

In the example as shown in FIG. 1, the flow-limiting device 10 is further provided with axial ribs 30 which are evenly distributed around the outer circumference of the peripheral wall 20 of the body. The axial ribs 30 are integrally formed with the body of the flow-limiting device. In the mounted state, the axial ribs 30 and/or the neck of the container become elastically deformed and create a force-fit between the flow-limiting device 10 and the container 12. In the example as shown in FIG. 1, the axial ribs 30 start close to the upper axial end of the peripheral side 20 but do not extend up to the lower axial end 22. However, it is also possible to provide the axial ribs 30 such that they extend in axial direction up to the lower axial end 22 of the peripheral side 20.

The container is further provided with a removable or openable cap for closing the container opening. Such a cap can be a standard cap which can be screwed onto the container opening. The cap can also be attached to the container by the mean of a retaining ring that is snapped onto the container opening. To this end, one or more beads 32 are integrally formed with the wall 14 of the container.

The flow-limiting device 10 is made of a suitable plastic material which is preferably selected from the group comprising radical or linear high and low density polyethylenes, copolymers of ethylene such as for example ethylene vinyl acetates, ethylene ethyl acrylates, ethylene butyl acrylates, ethylene maleic anhydrides, ethylene alpha olefines, regardless of the methods of polymerisation or modification by grafting, homo polypropylene and copolymers, polybutene-1, polyisobutylene. Polyolefines are preferably selected to make the flow-limiting device 10 for cost reasons and because they are easy to use.

Other polymer materials can be considered however such as polyvinyl chloride, copolymers of vinyl chloride, polyvinylidene chlorides, polystyrenes, copolymers of styrene, derivatives of cellulose, polyamides, polycarbonates, polyoxymethylenes, polyethylene terephthalates, polybutylene terephthalates, copolyesters, polyphenylene oxides, polymethyl methacrylates, copolymers of acrylate, fluoride polymers, polyphenylene sulphides, polyarylsulphones, polyaryletherketones, polyetherimides, polyimides, thermoplastic elastomers, polyurethanes, phenol resins, melamine resins, urea resins, epoxy resins and unsaturated polyester resins.

Biodegradable polymer materials, with for example a starch base, are also possible such as polylactic acids (PLA).

Combinations of these polymers can be used, if desired. The polymer used to produce the body of the flow-limiting device 10 can also contain one or more additives such as elastomers, fibers, expanding agents, additives such as stabilizers and colorants, sliding agents, demolding agents, adhesion agents or reinforced catching agents and/or any others according to the requirements of usage.

The flow-limiting device 10 can also be made from injectable materials made in such a way that they are capable of absorbing various different pollutants such as humidity, oxygen, odour and other possible pollutants. The thermoplastic materials are thus themselves formulated with additives belonging to a group of humidity absorbers, oxygen scavengers, odour absorbers and/or emitters of volatile olfactory organic compounds. The formulated thermoplastic materials must however retain a certain degree of resilience.

Suitable dehydrating agents are selected from a group comprising silica gels, dehydrating clays, activated alumina, calcium oxide, barium oxide, natural or synthetic zeolites, molecular or similar sieves, or deliquescent salts such as magnesium sulfide, calcium chloride, aluminum chloride, lithium chloride, calcium bromide, zink chloride or the like. Preferably the dehydrating agent is a molecular sieve and/or a silica gel.

A suitable oxygen collecting agent is selected from a group comprising metal powders having a reducing capacity, in particular iron, zink, tin powders, metal oxides still having the ability to oxidize, in particular ferrous oxide, as well as compounds of iron such as carbides, carbonyls, hydroxides, used alone or in the presence of an activator such as hydroxides, carbonates, sulfites, thiosulfates, phosphates, organic acid salts, or hydrogen salts of alkaline metals or alkaline earth metals, activated carbon, activated alumina or activated clays.

Other agents for collecting oxygen can also be chosen from specific reactive polymers such as those described for example in the U.S. Pat. No. 5,736,616 and WO 99/48963. These specific reactive polymers can be mixed with a thermoplastic polymer used to produce the flow-limiting device according to the present invention.

The amount of treatment agent introduced into the thermoplastic polymer to produce the flow-limiting device according to the present invention expressed in percentage by weight can advantageously vary from 5% to 75% of the thermoplastic material used to produce the flow-limiting device, when the treatment agent is a reaction and/or adsorption agent.

Figure 2A:
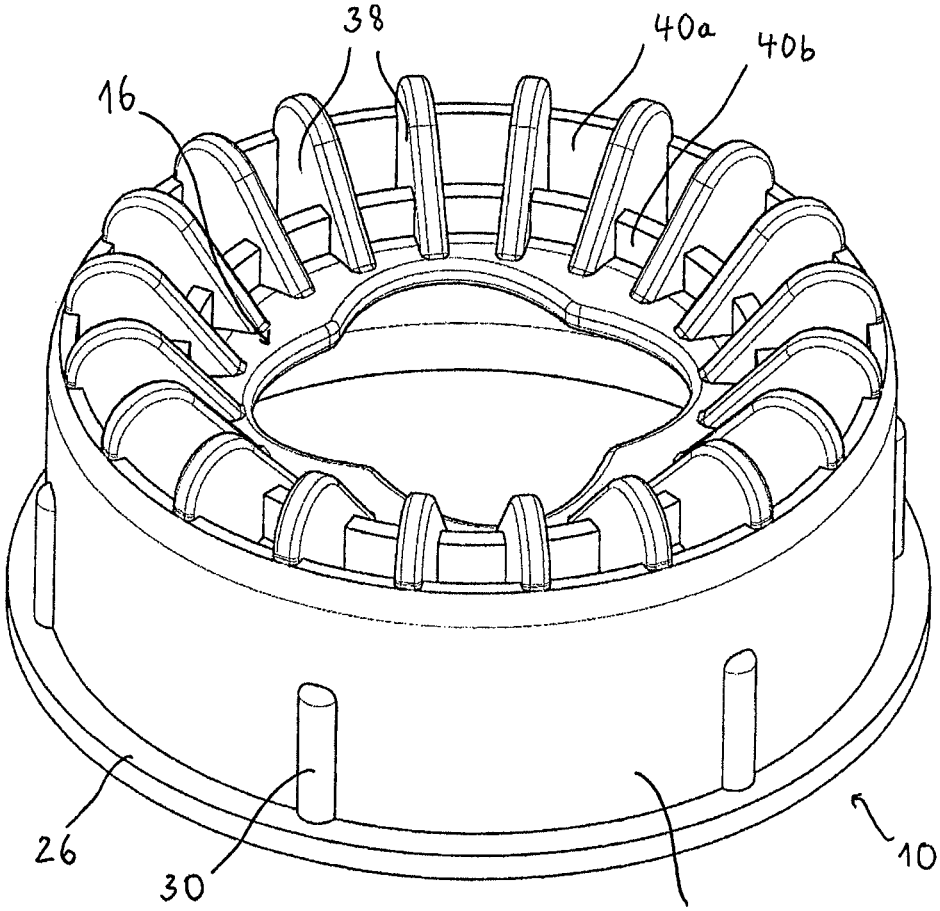
FIGS. 2*a* and 2*b* are views showing the entry side and dispensing side, respectively of an embodiment of a flow-limiting device according to the invention.
Figure 2B:
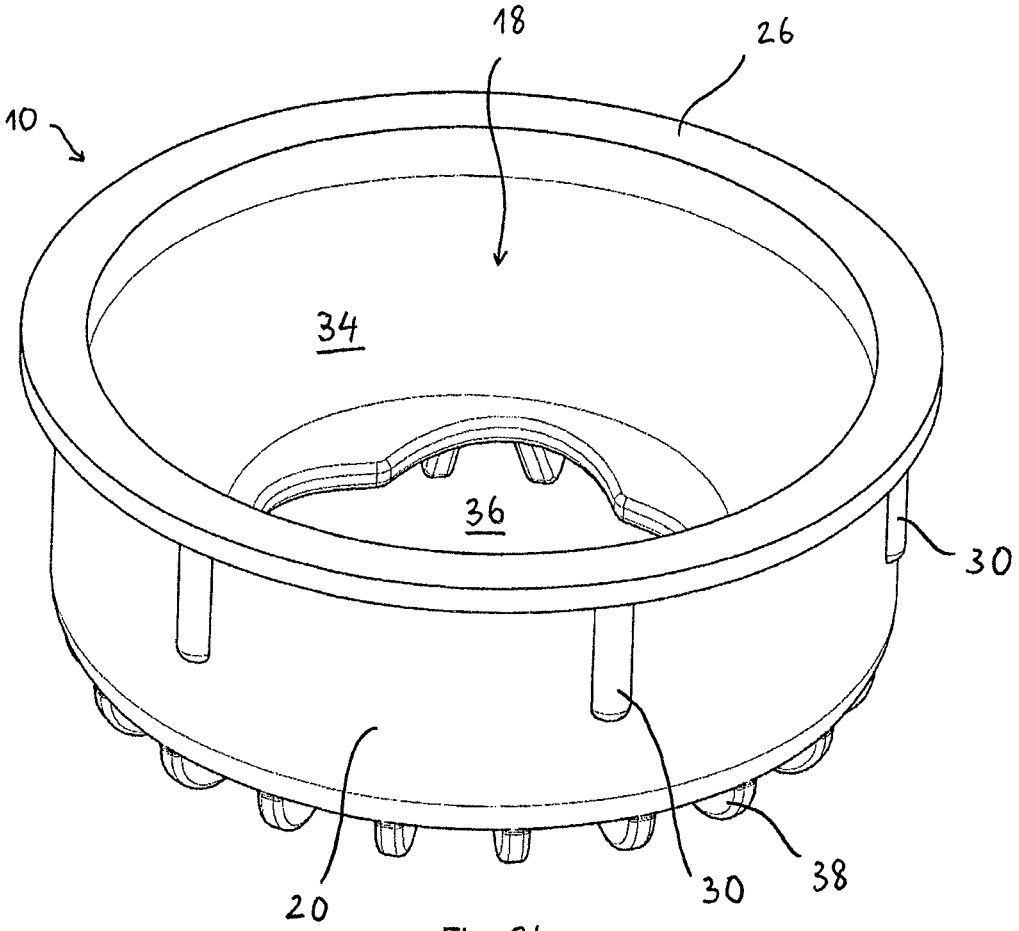

FIGS. 2*a* and 2*b* show a flow-limiting device according to FIG. 1. The flow-limiting device has a wall 34 which is concave at the dispensing side 18 of the flow-limiting device 10 and which is provided with a centrally arranged dispensing opening 36.

At the entry side 16, there is no continuous wall. The entry side 16 comprises a plurality of radial ribs 38 which preferably are evenly distributed over the circumference of the flow-limiting device. Further, there are circumferential ribs 40*a* and 40*b* which are concentrically arranged and intersect the radial ribs 38. More particularly, the circumferential rib 40*a* merges into the peripheral wall 20. The ends of the radial ribs 38 and circumferential ribs 40*a*, 40*b* facing the interior of the container are elevated surfaces which together form a concave shape of the entry side 16 when viewed onto the entry side 16. The radial ribs 38 and circumferential ribs 40*a*, 40*b* form a web of elevated surfaces which are arranged so as to impart a sufficient stability to the thin-walled flow-limiting device 10 and such that the loose products stored inside a container used with the flow-limiting device 10 cannot become stuck between the ribs of the container.

The elevated surfaces of the ribs 38, 40*a*, 40*b* form a guiding surface which directs the products to be dispensed towards the dispensing opening 36 when the container (not shown in FIGS. 2*a* and 2*b*) with the flow-limiting device 10 fitted therein is placed in an upside down position.

Figure 3:
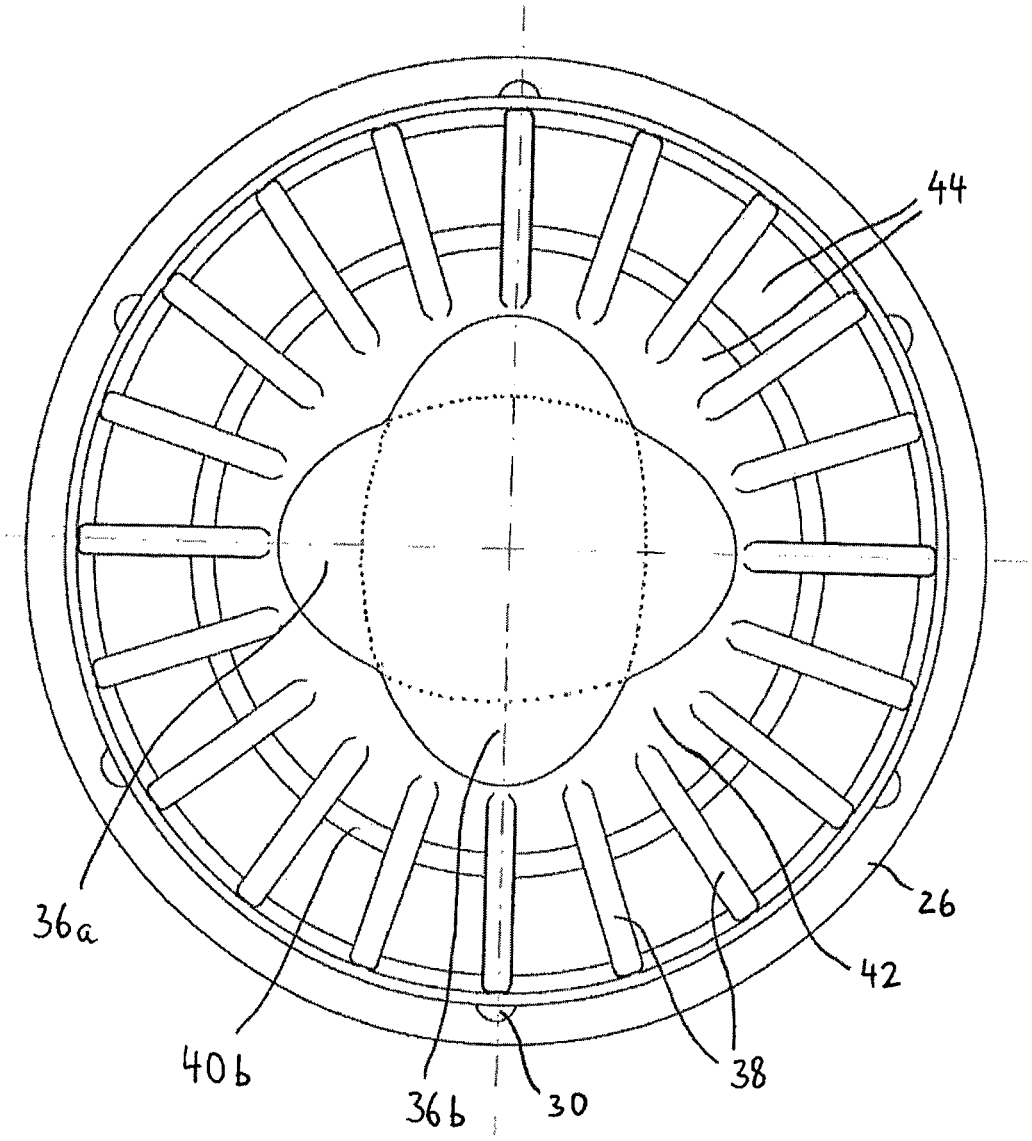
FIG. 3 is a view onto the entry side of a flow-limiting device according to the invention.

Finally, the entry side of the flow-limiting device according to FIGS. 2*a* and 2*b* is provided with a flat surface region 42 around the dispensing openings 36*a*, 36*b* (which are shown in FIG. 3).

FIG. 3 shows a plan view onto the entry side of a flow-limiting device according to FIGS. 2*a* and 2*b*. As can be best seen in the plan view of FIG. 3, the dispensing opening 36 consists of two elliptical openings 36*a*, 36*b*, the shapes of which are shown by way of dotted lines. The longitudinal axes of the elliptical dispensing openings 36*a* and 36*b* are arranged at an angle of 90°. However, it should be noted that it is also possible to provide one single elliptical or elongated hole as the dispensing opening, or a plurality of dispensing openings, the longitudinal axes of which are arranged the different angle relative to each other or which are not arranged so as to intersect each other.

The intersecting radial ribs and circumferential rib form elevated portions delimiting recessed portions 44. The recessed portions are shaped such that a unitary product intended to be dispensed with the flow-limiting device 10 cannot become stuck therein.

Figure 4A:
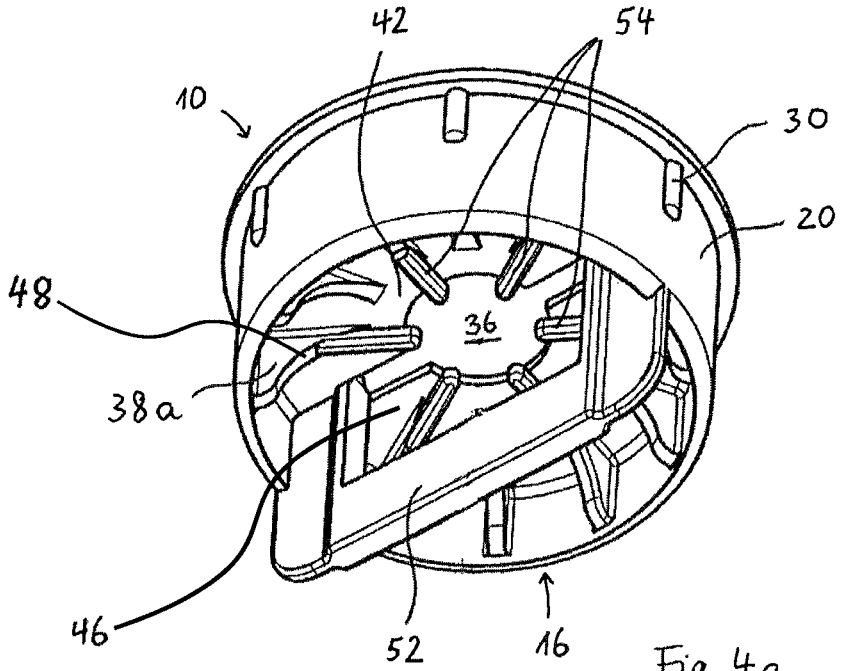
FIGS. 4*a* and 4*b* show another embodiment of a flow-limiting device according to the invention.
Figure 4B:
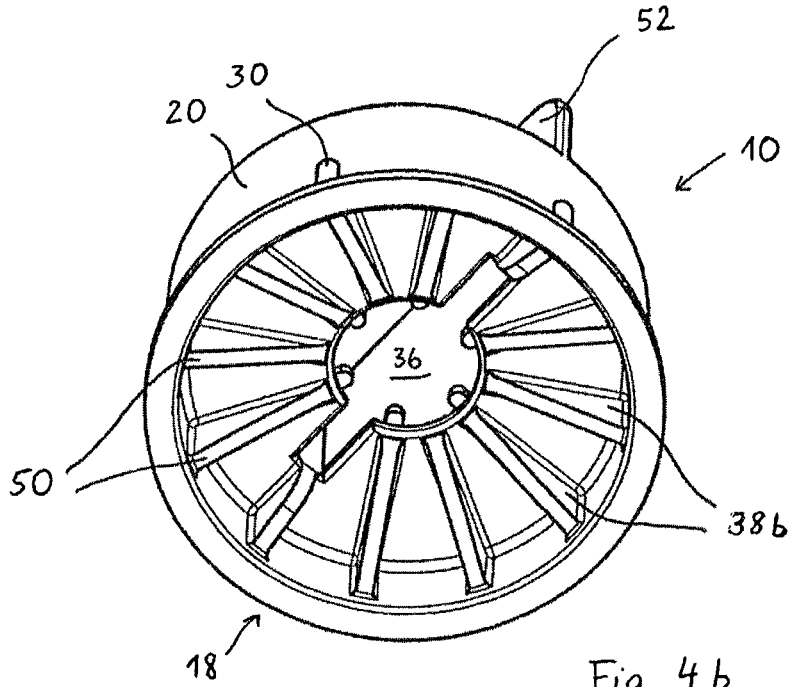

The flow-limiting device of the embodiment according to FIGS. 4*a*, 4*b* is provided with a flat annular wall 46 with a dispensing opening 36 therein. Both the concave shapes of the entry side 16 and dispensing side 18 are formed by means of radial ribs 38*a*, 38*b*. The radial ribs 38*a* on the entry side 16 have a curved shape so as to form a concave overall shape. Also in this example, the elevated top surfaces of the radial ribs 38*a* act as guiding surfaces 48 which, in the appropriate orientation of the container with the flow-limiting device 10 fitted thereon, serve to guide the unitary products to be dispensed towards the dispensing opening 36.

On the dispensing side 18 of the flow-limiting device 10 according to FIG. 4*b*, the radial ribs 38*b* form a generally straight guiding surface 50 so that the plurality of straight guiding surfaces 50 of the radial ribs 38*b* form the skeleton of a funnel shape. Such a shape is also considered to be covered by the term "concave". Upon correct orientation of the flow-limiting device, a product which was inadvertently dispensed will be redirected towards the dispensing opening and back into the interior of the container.

In order to show that different geometrical variations can be applied, there is a flat surface 42 surrounding the dispensing opening 36 on the entry side 16, whereas, on the dispensing side 18, the radial ribs 38*b* extend up to the rim of the dispensing opening 36.

In the embodiment according to FIGS. 4*a* and 4*b*, a bow 52 is provided which is integrally formed with the flow-limiting devices. The bow 52 is a narrow, blade-like element which is placed on the entry side of the flow-limiting device and at some distance from the opening 36. The bow has the function to limit the flow of unitary products if a user who wants to dispense a product turns the container with the flow-limiting device into an upside-down position. In such a position, the products could freely fall into the dispensing opening 36. When the flow-limiting device in a container is turned into an upside-down position, the bow is arranged such that it crosses the cross sectional area of the opening 36.

Further, a plurality of flow breaking elements 54 are shown which start on the entry side 16 of the flow-limiting device and extend into the free cross-sectional area of the opening 36. The flow breaking elements 54 are distributed around the rim of the dispensing opening and have the function to limit the flow of unitary products towards and through the dispensing opening. This promotes the desired dispensing of the unitary products one by one.

It should be noted that the provision of the bow 52 and the flow breaking elements 54 is shown and described only in the context of the embodiment of FIGS. 4*a* and 4*b*. However, it should be noted that one or both of these elements can be additionally provided in any of the other embodiments.

Figure 5:
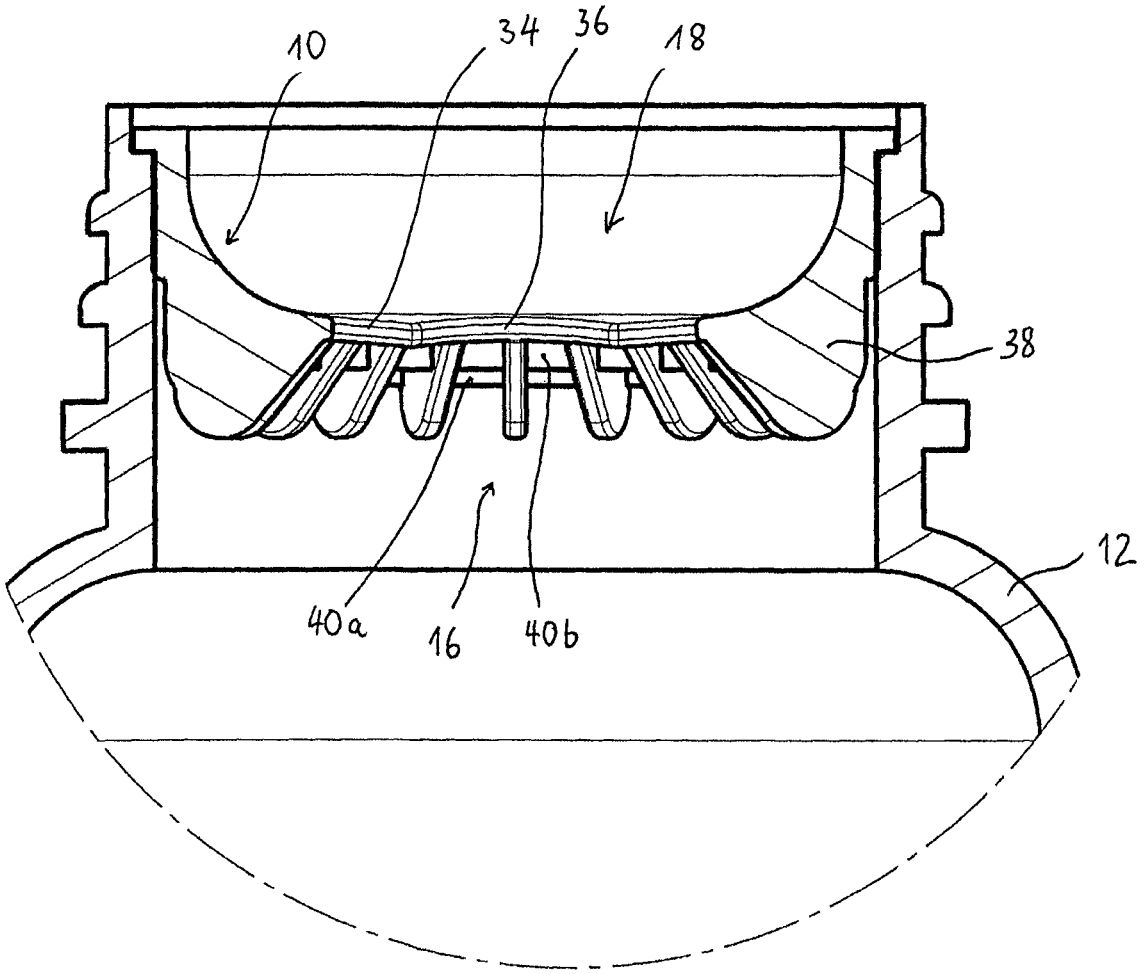
FIG. 5 is a view of a container with a neck into which a flow-limiting device according to the invention is fitted.

The container as shown in FIG. 5 has a neck and the flow-limiting device 10 inserted therein. Once the cap (not shown) closing the neck portion of the container has been removed from the container opening, the container has to be turned over so that it comes into a bottom-up position. In such a position, one unitary product will be directed by means of the guiding surface on the entry side of the container towards the dispensing opening and will be dispensed. In case that more than one product was dispensed, the bottle can be put back into the upright position as shown in FIG. 5, whereupon the product will slide down the guiding surface on the dispensing side and will drop through the dispensing opening back into the interior of the container. After this, the container can be closed again by means of the cap.

The flow-limiting device according to the invention is easy to use because single pieces of the product can be conveniently returned into the container. It is of a lightweight construction and provides a high surface area which, in case of adding an active agent to the polymer matrix of the plastic material of the flow-limiting device, will also lead to a high effectiveness of the desired material exchange in order to create or maintain a desired atmosphere within the container.

The invention claimed is:

1. A flow-limiting device that controls distribution of unitary products from a container which holds said unitary products, the flow-limiting device comprising:

a body made of a polymeric material comprising an entry side, a dispensing side and a peripheral side, the peripheral side having a lower axial end and an upper axial end; and at least one dispensing opening;

the entry side having, at least in part, a concave shape when viewed onto the entry side with at least one guiding surface;

the dispensing side having, at least in part, a concave shape when viewed onto the dispensing side;

the at least one dispensing opening being at an axial position between and spaced from an axial position of the lower axial end and an axial position of the upper axial end of the peripheral side; wherein at least one among the entry side and the dispensing side comprises a plurality of elevated regions and recessed regions between the elevated regions, wherein the plurality of elevated regions define the concave shape of the at least one among the entry side and the dispensing side.

2. The flow-limiting device according to claim 1, wherein the at least one dispensing opening comprises a hole having a shape that is dimensioned to a shape of the unitary product so that only one unitary product at a time can pass through the at least one dispensing opening.

3. The flow-limiting device according to claim 1, wherein the at least one dispensing opening comprises elongate holes or elliptical holes, wherein longitudinal axes thereof form an angle with each other.

4. The flow-limiting device according to claim 1, wherein the polymeric material comprises a thermoplastic material and an active gas treatment material or gas treatment composition embedded in a polymer matrix of the thermoplastic material.

5. The flow-limiting device according to claim 4, wherein the gas treatment material comprises an oxygen scavenger.

6. The flow-limiting device according to claim 4, wherein the gas treatment material comprises a sorbent material.

7. The flow limiting device according to claim 4 wherein the gas treatment material comprises a desiccant material or desiccant composition.

8. The flow-limiting device according to claim 1, wherein the plurality of elevated regions comprise a plurality of radial ribs.

9. The flow-limiting device according to claim 8, further comprising intersecting ribs.

10. The flow-limiting device according to claim 1, further comprising an annular flange located at a circumference of the dispensing side, wherein the annular flange extends radially outwards from the upper axial end of the peripheral side.

11. The flow-limiting device according to claim 1, further comprising axial ribs extending in a longitudinal direction of the flow-limiting device at a circumference thereof.

12. The flow-limiting device according to claim 1, wherein the plurality of elevated regions comprise at least one circumferential rib arranged concentrically with respect to a longitudinal axis of the flow limiting device.

13. The flow-limiting device according to claim 12, further comprising intersecting ribs.

14. The flow-limiting device of claim 3, wherein the longitudinal axes form an angle with each other between 80° and 100°.

15. The flow limiting device according to claim 1, wherein the plurality of elevated regions form ribs.

16. The flow limiting device of claim 1 wherein the at least one dispensing opening is an elongate hole or elliptical hole.

17. A container for storing unitary products, in its interior, the container comprising:

the flow-limiting device according to claim 1;

a container body with a container opening; and a removable or openable cap for closing the container opening;

wherein the flow-limiting device is arranged in the interior of the container and close to the container opening; and the at least one dispensing opening of the flow-limiting device is dimensioned to allow passage of one unitary product at a time.

18. The container according to claim 17, wherein the flow-limiting device is snap-fit into the container, and establishes a form-fit connection in the container.

19. The container according to claim 17, further comprising an opening surrounded by a wall, and the flow-limiting device further comprising an annular flange at the upper axial end of the peripheral side of the body, wherein the annular flange covers at least a part of the wall around a neck portion of the container.

20. The container according to claim 17, further comprising a neck portion, which comprises the container opening.

* * * * *